United States Patent [19]

Kimura et al.

[11] Patent Number: 4,527,140

[45] Date of Patent: Jul. 2, 1985

[54] SPLIT TYPE ZERO-PHASE TRANSFORMER WITH HOLDER FOR MOUNTING ON AN ELECTRICAL CABLE

[75] Inventors: Kenzi Kimura, Sakura; Hiroyuki Kanda, Iwatsuki, both of Japan

[73] Assignee: Midori-Anzen Industry Co., Ltd., Tokyo, Japan

[21] Appl. No.: 510,430

[22] Filed: Jul. 1, 1983

[30] Foreign Application Priority Data

Jul. 10, 1982 [JP] Japan ..... 57-104720

[51] Int. Cl.[3] ..... H01F 40/06

[52] U.S. Cl. ..... 336/175; 174/153 G; 174/155; 248/56

[58] Field of Search ..... 174/153 G, 154, 155, 174/156, 167, 40 CC; 248/56; 324/127; 336/175, 176, 174; 16/2, 108, 109; 267/141.2, 141.6, 153; 403/224, 225, 227

[56] References Cited

U.S. PATENT DOCUMENTS 2,387,295 10/1945 Robertson ..... 174/40 CC X
3,366,356 1/1968 Fisher ..... 174/153 G X

FOREIGN PATENT DOCUMENTS 2335024 7/1977 France ..... 336/175
54-129316 10/1979 Japan ..... 336/176

*Primary Examiner*—Laramie E. Askin
*Attorney, Agent, or Firm*—Prutzman, Kalb, Chilton & Alix

[57] ABSTRACT

A holder for mounting a split type zero-phase current transformer on an electric wire or cable. The holder has a cylindrical portion made from a flexible material such as a rubber and is provided with a slit extending over the entire axial length thereof. At least one protrusion protrudes inwardly from the inner surface of the cylindrical portion. This holder can be used for a large variety of diameters of electric wire or cable in mounting the split type zero-phase current transformer on such electric wire or cable.

4 Claims, 4 Drawing Figures

SPLIT TYPE ZERO-PHASE TRANSFORMER WITH HOLDER FOR MOUNTING ON AN ELECTRICAL CABLE

BACKGROUND OF THE INVENTION (1) Field of the Invention

The present invention is concerned with a holder for mounting a split type zero-phase current transformer or other types of current transformer (referred to simply as "split type zero-phase current transformer", hereinunder) on an already laid or unlaid electric wire or cable.

(2) Description of the Prior Art

Hitherto, for mounting a split type zero-phase current transformer on an already-laid or unlaid electric wire or cable, it has been a common measure to use fastening parts such as fastening bands or the like fastening structures. This inconveniently complicates the construction of the split type zero-phase current transformer. In addition, the work for mounting the current transformer on the wire or cable is quite troublesome. Moreover, it is necessary to vary the sizes of the window holes or the constructions of the fastening parts and fastening structures in order to meet a variety of different diameters of wire and cable.

(3) Brief Summary of the Invention

Accordingly, it is a first object of the invention to provide a holder capable of mounting a split type zero-phase current transformer on electric wires or cables of different diameters.

It is a second object of the invention to provide a holder for mounting a split type zero-phase current transformer on an electric wire or cable, without requiring any fastening parts or structures, wherein the holder can automatically clamp the electric wire or cable as the halves of the split type zero-phase current transformer are coupled to each other.

It is a third object of the invention to provide a holder which can facilitate the work for mounting a split type zero-phase current transformer on an electric wire or cable.

The nature, principle and details of the invention will become clear from the following description of the preferred embodiment taken in conjunction with the accompanying drawings.

DESCRIPTION OF THE PREFERRED EMBODIMENT

Figure 1:
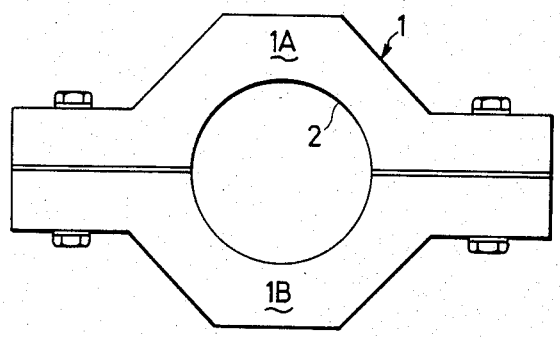
FIG. 1 shows an example of a split type zero-phase current transformer.
Figure 2:
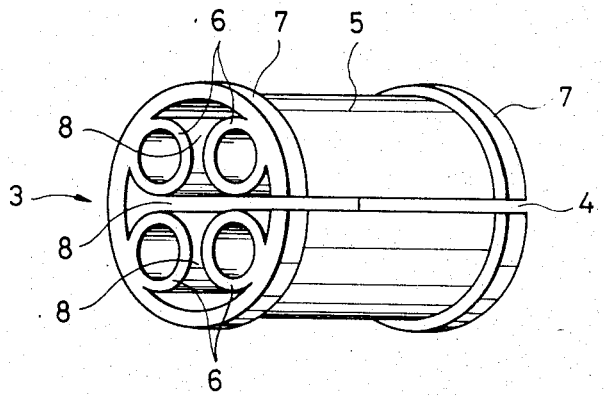
FIG. 2 is a perspective view of a holder of the invention for mounting a split type zero-phase current transformer.
Figure 3:
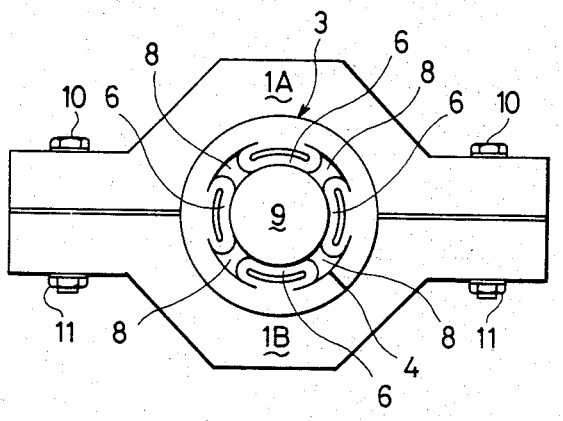
FIG. 3 is an end view of the holder shown in FIG. 3 in the state of use.
Figure 4:
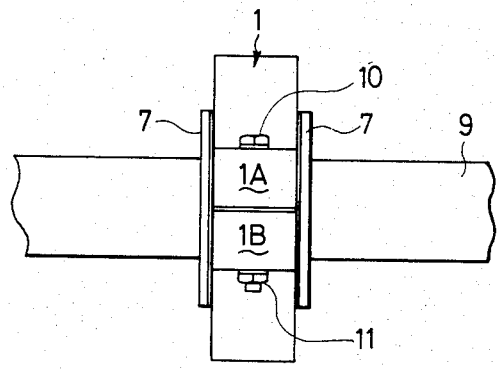
FIG. 4 is a side elevational view of the holder in the state of use.

A preferred embodiment of the invention will be described with reference to the accompanying drawings.

Referring to the drawings, a reference numeral 1 designates a split type zero-phase current transformer composed of two halves 1A and 1B. The split type current transformer 1 has a window hole 2 for receiving an electric wire, cable or the like. The split type zero-phase current transformer 1 is adapted to be mounted on any desired portion of the wire or cable by means of a holder designated at a reference numeral 3. The holder 3 is made from a flexible material such as a rubber to have a cylindrical form to be connected to the window hole 2. More specifically, the holder 3 has a cylindrical portion 5 having an axially extended slit 4 and four protrusions 6 having the forms of pipes of an equal diameter and protruded radially inwardly at a constant interval from the inner surface of the cylindrical portion 5. Flanges 7 are formed on both axial ends of the cylindrical portion 5 to extend outwardly therefrom. When the window hole 2 of the split type current transformer 1 is fitted around the cylindrical portion 5, the flanges 7 effectively prevent the split type zero-phase current transformer from moving off from the cylindrical portion 5. The slit 4 is formed in the portion of the wall of the cylindrical portion between a pair of adjacent protrusions 6,6. A slight gap 8 is preserved between each two adjacent protrusions.

The holder of the invention for the split type zero-phase current transformer is constructed as explained hereinabove, and is used in a manner explained hereinunder. The holder 3 is deformed by a force to move the opposing edges of the slit 4 away from each other to receive the electric wire or cable 9 and is then relieved from the force so that the cylindrical portion 5 recovers to the original form due to its elasticity. The recovery of the original shape, however, is ceased to stop the closing of the slit 4 when the outer peripheral surface of the electric wire or the cable 9 is contacted by the protrusions 6. Then, two halves 1A and 1B of the split type zero-phase current transformer 1 are moved toward each other from both sides of the holder 3 to fit the window hole on the outer peripheral surface of the cylindrical portion 5. Thereafter, halves 1A and 1B are coupled to each other by means of bolts 10 and nuts 11, so that the cylindrical portion 5 is compressed to cause a deformation of the protrusions 6 on the outer peripheral surface of the electric wire or cable 9, thereby to fix the holder 3. In consequence, the split type zero-phase current transformer 1 is immovably mounted on the electric wire or cable 9. It will be seen that the holder of the invention can be used for a variety of diameters of the electric wire or cable 9, including such a small diameter that the protrusions 6 are lightly compressed and deformed and such a large diameter that the protrusions are fully deformed, with the slit fully or partially closed.

The embodiment described hereinbefore is not exclusive. For instance, it is possible to provide other numbers of the protrusions 6 than four on the cylindrical portion 5. It is also possible to enlarge or reduce the diameter of the cylindrical portion 5 with a suitable number of protrusions 6 on each section of the increased or decreased diameter. The protrusions may be provided with a roughened surface to prevent any slip, and may have any hollow shape easy to deform or collapse other than tubular form. Such changes and modificatios are within the matter of design choice.

As will be understood from the foregoing description, according to the invention, it is possible to fix the holder on an already-laid or unlaid electric wire or cable through elastic deformation of the protrusions provided on the inner surface of the cylindrical portion of the holder, so that a holder of one size can be used for a variety of diameters of electric wire or cable to mount the split type zero-phase current transformer on the electric wire or cable.

Furthermore, since the holder is automatically fastened to the electric wire or cable simply by clamping the halves of the split type zero-phase current transformer, it is not necessary to employ any specific fastening parts or structures. Thus, according to the invention, it is possible to obtain a holder having a simplified construction and easy to attach to the cable.

What is claimed is:

1. In combination, a split type zero-phase current transformer having upper and lower members and means for detachably coupling said upper member to said lower member, said upper and lower members forming an aperture for mounting about an electrical cable when said upper member is coupled to said lower member, a holder for mounting said transformer on an electrical cable comprising a cylindrical portion having an axial bore and made of flexible material dimensioned for mounting within the aperture of said transformer, said cylindrical portion having an upper portion and a lower portion with an axially extending slit extending over the entire length thereof for forced resilient separation of said upper portion from said lower portion along said slit for insertion of an electrical cable into the axial bore of said cylindrical portion, and at least one deformable protrusion protruding inwardly from the inner surface of said cylindrical portion and being configured for deformation to immovably mount the tranformer and holder to an electric cable when the electrical cable extends through the axial bore of the cylindrical portion of the holder mounted within the aperture of the coupled members of the transformer, an electrical conductor cable inserted through the axial slit of said holder so as to extend through the axial bore of said cylindrical portion in abutting contact with said at least one deformable protrusion, and said holder being mounted between said upper and lower members of said transformer with said upper member being coupled to said lower member so as to compress said protrusion against said electric cable causing deformation sufficient to immovably secure said transformer to said electrical cable.

2. The combination according to claim 1, wherein said protrusion has a hollow tubular form extending in the axial direction of said axial bore.

3. The combination according to claim 1, wherein said protrusion is provided with a roughened surface.

4. The combination according to claim 1 wherein said holder comprises a plurality of deformable protrusions protruding inwardly from the inner surface of said cylindrical portion, said protrusions being dimensioned and configured for deformable compression by a range of diametral sizes of electrical cable sufficient to immovably mount said holder to any one of said range of diametral sizes of electrical cable.

* * * * *